United States Patent [19]

Moore

[11] Patent Number: 4,953,067

[45] Date of Patent: Aug. 28, 1990

[54] SUSPENSION AND POWER CONNECTOR FOR ILLUMINATED HOUSE NUMBER SIGNS

[76] Inventor: Deborah Moore, 3561 Beatrice, Detroit, Mich. 48217

[21] Appl. No.: 437,729

[22] Filed: Nov. 17, 1989

[51] Int. Cl.[5] ..... F21S 1/10

[52] U.S. Cl. ..... 362/431; 362/217; 362/812; 40/575; 40/576; 248/343

[58] Field of Search ..... 362/226, 217, 431, 812, 362/291; 248/343, 344; 40/575, 576, 564, 571, 540, 577

[56] References Cited

U.S. PATENT DOCUMENTS

| | | | |
|---|---|---|---|
| 1,668,799 | 5/1928 | Bergan | 40/576 |
| 1,887,523 | 11/1932 | Schenkel | 40/577 |
| 1,998,857 | 4/1935 | Wolff | 40/577 |
| 2,147,033 | 2/1939 | Hays | 40/577 |
| 2,565,575 | 8/1951 | Rosenthal | 362/812 |
| 2,707,346 | 5/1955 | Fuller | 40/576 |
| 2,798,323 | 7/1957 | Witz | 40/576 |
| 3,248,534 | 4/1966 | Cahill et al. | 248/343 |
| 3,321,615 | 5/1967 | Hilzen | 362/217 |
| 3,516,187 | 6/1970 | Espinosa | 40/553 |
| 3,864,861 | 2/1975 | Hill | 40/576 |
| 4,373,284 | 2/1983 | Crane | 40/576 |

FOREIGN PATENT DOCUMENTS

| | | | |
|---|---|---|---|
| 657720 | 2/1949 | United Kingdom | 362/217 |

*Primary Examiner*—James C. Yeung
*Attorney, Agent, or Firm*—Dykema Gossett

[57] ABSTRACT

A suspension and power connector for illuminated house number signs includes an apertured mount plate which receives and is supported by a power connector body. An apertured anchor plate receives the body and bears against the mount plate. Suspension brackets underlie the anchor plate with fasteners connecting the brackets and anchor plate to the mount plate. The body at one end includes a threaded connector adapted for support, assembly into an electrified socket on a porch ceiling. The body at its other end has an electric socket adapted to receive an incandescent bulb. A housing for a house number sign has a transparent front wall and an open top which extends over the bulb, engages the anchor plate and is secure thereto by the brackets.

18 Claims, 2 Drawing Sheets

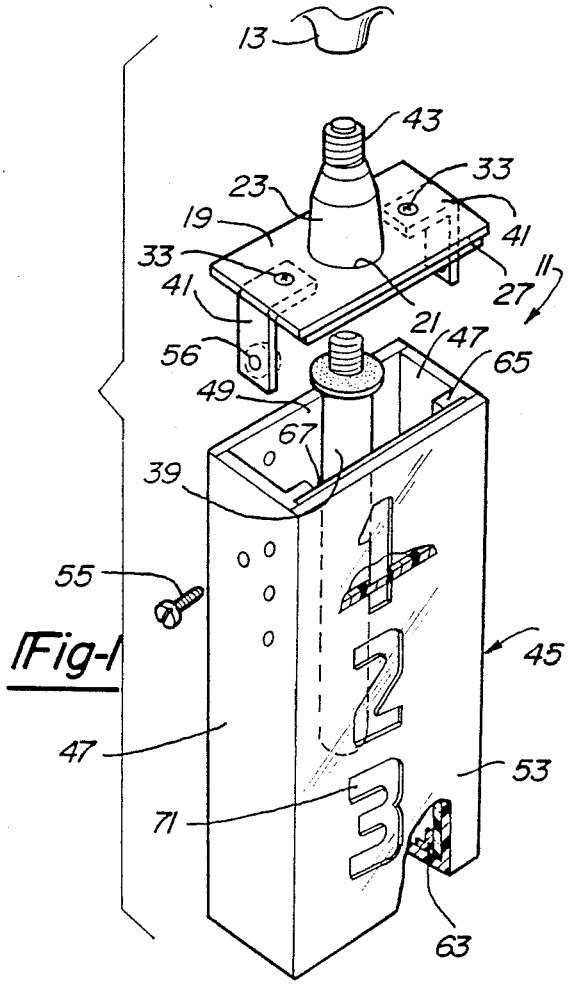
Fig-1
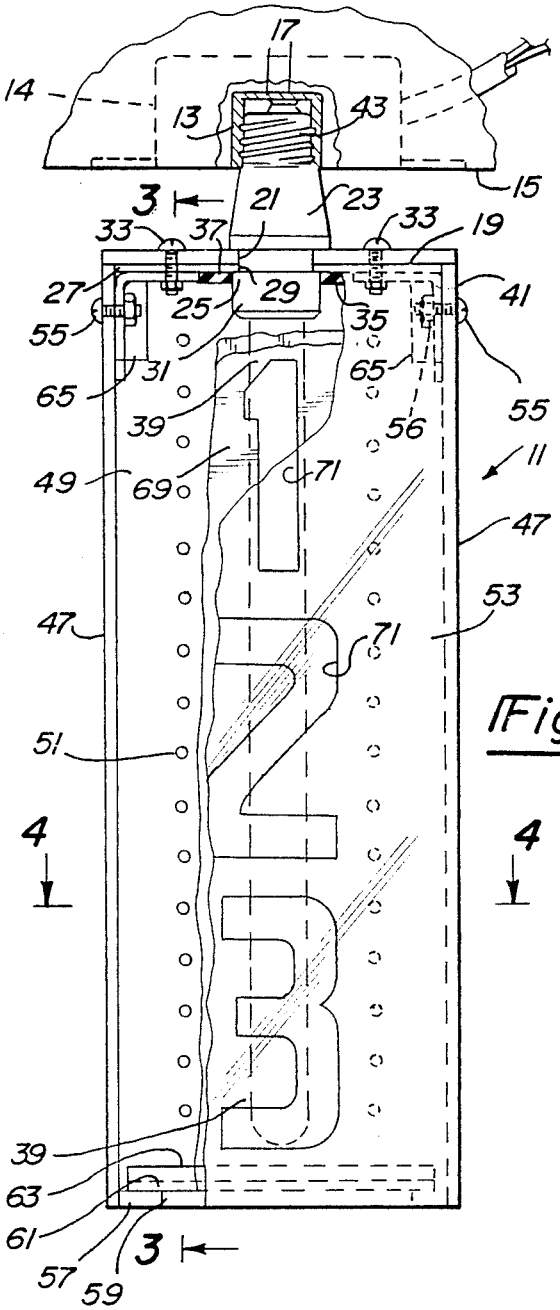
Fig-2
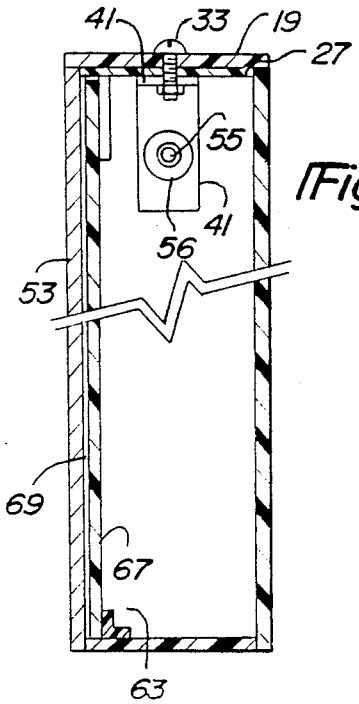
Fig-3
Fig-4
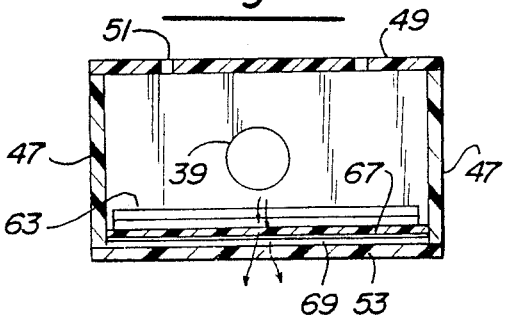

SUSPENSION AND POWER CONNECTOR FOR ILLUMINATED HOUSE NUMBER SIGNS

FIELD OF THE INVENTION

The present invention relates to illuminated house number signs and more particularly to a suspension and power connector for the sign. A light source illuminates the numerical cut-out indicia on an opaque card for reading house numbers at night.

BACKGROUND OF THE INVENTION

Previously, there have been numerous efforts to provide illuminated house number signs. Various means have been employed to transmit an internal light source through numerical indicia cut-outs in an opaque strip.

THE PRIOR ART

The following U.S. Pats. are illustrative of such prior art efforts:

| NUMBER | INVENTOR | DATE OF INVENTION |
|---|---|---|
| 1,668,799 | N. Bergan | May 8, 1928 |
| 1,887,523 | E. S. Schenkel | November 15, 1932 |
| 1,998,857 | H. Wolff | April 23, 1935 |
| 2,147,033 | W. W. Hays | February 14, 1939 |
| 2,707,346 | T. J. D. Fuller, Jr. | May 3, 1955 |
| 2,798,323 | P. Witz | July 9, 1957 |
| 3,516,187 | A. O. Espinosa | June 23, 1970 |
| 3,864,861 | R. H. Hill, Jr. | February 11, 1975 |
| 4,373,284 | Crane | February 15, 1983 |

SUMMARY OF THE INVENTION

An important feature of the present invention is to provide a suspension and power connector for an illuminated house number sign wherein the power connector is adapted for assembling into an electrified socket within a ceiling and further serves as the sole suspension for the illuminated sign depending therefrom.

As another feature the present suspension and power connector includes a mount plate having a central aperture with an upright power connector having a body and a longitudinal axis projected through and supportably engaging the mount plate. An anchor plate having a central aperture receives the body bearing against the mount plate. A pair of opposed apertured suspension brackets overlie the mount plate and extend from its opposite ends and are adapted to receive and have secured thereto a housing for a house number sign enclosing a bulb threaded into the power connector.

As still another feature the housing for the house number sign has at least one transparent front wall, side and back walls, bottom wall and an open top and is adapted for projection over the depending brackets and into engagement with the anchor plate for closing off the housing and is secured thereto by a pair of opposed fasteners which extend through upper end portions of the respective side walls of the housing and through the brackets.

As another feature, the housing may be rectangular or square in cross-section or triangular. In the latter case, the housing will include a pair of converging, transparent forwardly extending side walls together with a rear wall which cooperatively underlie the anchor plate and which encloses the incandescent bulb depending from the power connector.

Separation of the housing from the suspension and power connector is achieved by removal of a pair of fasteners on the brackets for access to the bulb and for replacement thereof as required.

As still another feature within the housing adjacent the transparent wall or walls thereof there is provided a first channel on the bottom wall of the housing. Corresponding opposed and aligned channels secured to upper portions of the housing are adapted to supportably receive a translucent plate arranged outwardly of the bulb wherein an opaque card of similar shape has a series of numerical indicia cut-outs therein corresponding to house numbers transmitting light therethrough for reading the house number at night. The cut-out opaque card is interposed between the adjacent translucent plate and the corresponding transparent wall of the housing.

As still another feature, the suspension and power connector and its mount plate are disposed within a corresponding aperture in the top wall of a laterally elongated housing secured thereto by the brackets on the mount plate, and wherein the connector body includes a pair of opposed outwardly opening threaded receptacles with each receptacle adapted to supportably receive a light bulb.

As still another feature, one of the end walls of the housing is hinged thereto and openable to provide access to one of the bulbs within the housing for removal of one bulb in order to permit disassembly of the power connector therefrom.

These and other features and objects will be seen from the following specification and claims in conjunction with the appended drawings.

THE DRAWINGS

FIG. 1 is a partly broken away and sectioned exploded perspective view of the present suspension and power connector and sign housing.

FIG. 2 is a partly sectioned broken away front elevational view thereof on an increased scale.

FIG. 3 is a fragmentary section taken in the direction of arrows 3—3 of FIG. 2 on a reduced scale.

FIG. 4 is a plan section taken in the direction of arrows {4—4 of FIG. 2.

Figure 5:
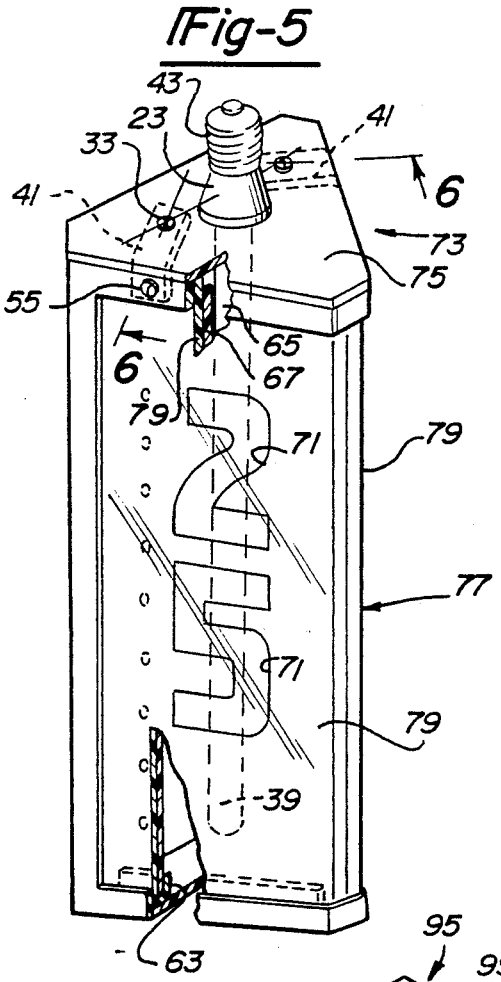
FIG. 5 is a partly broken away and sectioned front perspective view of a modified illuminated house number sign in conjunction with the present suspension and power connector.

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Referring to the drawings, FIGS. 1–4, the present suspension and power connector for illuminated house number signs is generally indicated at 11, FIG. 1.

A conventional threaded socket 13 is enclosed within an outlet box 14 recessed within a portion of the porch ceiling 15 or overhang of a house or other building and receives electrical power through the leads 17 which extend into the box and are connected to said socket, FIG. 2.

The present suspension power connector includes a horizontally disposed mount plate 19 of generally rectangular shape having a circular aperture 21. The power connector includes an elongated body 23 which extends through the aperture 21 and includes a shoulder 25 which supportably engages mount plate 19, FIG. 1.

Anchor plate 27, generally rectangular in shape, has a circular aperture 29 and receives power connector body 23 and is suitably secured to mount plate 19 as by the fasteners 33.

Apertured gasket seal 35 snugly surrounds a lower portion of the body 23 and is adhered to the under surface of the anchor plate 27 as by a suitable adhesive 37.

The power connector body 23 has a longitudinal axis, and arranged upon that axis is the bulb socket 31 adapted to cooperatively receive the elongated incandescent bulb 39.

A pair of opposed suspension brackets 41 centrally underlie opposite end portions of anchor plate 27. In the illustrative embodiment shown in FIG. 1, the brackets are of angular shape with their depending end portions apertured and adapted to receive the fasteners 55.

Upon the other end of the body 23 forming a part of the power connector there is provided a threaded male connector 43 which is threaded into the electrified socket 13 for supplying electrical power to the corresponding bulb socket 31 to which it is electrically connected.

The fasteners 33, sometimes referred to as first fasteners, extend through corresponding apertures in the mount plate 19 and anchor plate 27 and apertures within the mount brackets 41 are secured thereto as by the nuts illustrated in FIG. 2. Thus, the same fasteners 33 which secure the plates 19 and 27 together are effective for anchoring the brackets 41 upon the anchor plate 27.

In the illustrative embodiment shown in FIG. 1, housing 45 for a house number sign is generally rectangular in cross-section, has an open top, a pair of opaque side walls 47 and opaque rear wall 49 having a plurality of vent apertures 51 therein, and a front wall 53 of a clear plastic material.

The present housing 45 is adapted for projection up over the bulb 39 into engagement with the anchor plate 27 for closing off the interior of the housing and for securing to the suspension and power connector assembly as by the single pair of opposed fasteners 55 sometimes referred to as second fastener means.

Since the housing is enclosed, there are provided as a part of said second fastener means a pair of nuts 56 which are apertured and arranged upon the interior of the brackets and secured thereto adapted to easily and cooperatively receive the pair of fasteners 55 for anchoring the housing 45 with respect to the brackets 41 so as to underlie the assembly of the mount plate and anchor plate as in FIG. 2.

Thus, the pair of opposed fasteners 55 provide the sole connection and mounting and suspension of the sign housing to the mount plate 19 and brackets 41 for assembly over the bulb 39 and to provide access to the bulb for replacement, if needed.

Housing 45 includes bottom wall 57 apertured at 59 and further closed by a clear plastic plate 61 so that some light from the light source 39 may be transmitted below the sign housing.

In the use of the present illuminated house number sign there is provided the upturned elongated front channel 63 mounted and secured upon bottom wall 57 and arranged closely adjacent the transparent front wall 53. A pair of opposed top channels 65 are secured to upper portions of the corresponding side walls 47 of the housing and are arranged in alignment with front channel 63.

An elongated rectangular translucent plate 67, coextensive with the transparent front wall 53 is supportably nested within the respective channels 63 and 65 closely adjacent the transparent wall 53. An opaque number sheet 69 with suitable cut-out numbers 71, sometimes referred to as indicia is snugly interposed between the transparent front wall 53 and the translucent plate 67 with the number sheet further supported within the corresponding channels 63, 65.

Accordingly, on energization of the bulb 39 particularly at night, light will pass through the cut-out indicia 71 to illuminate the house numbers.

MODIFICATION

Figure 6:
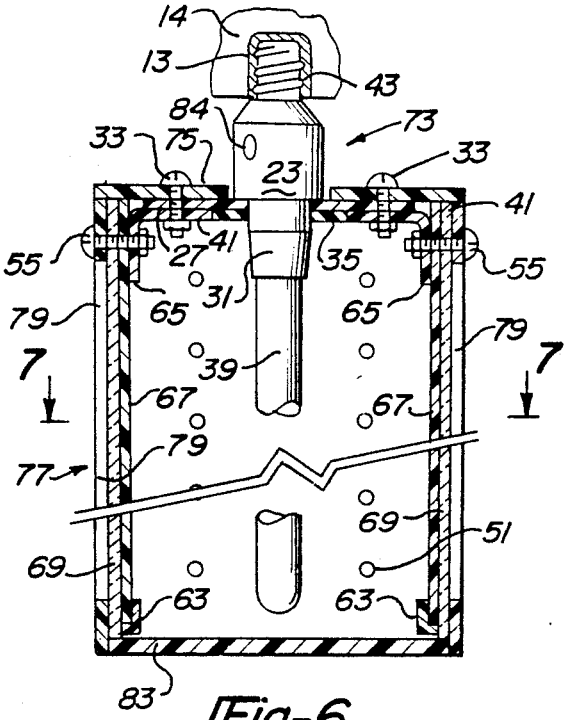
FIG. 6 is a fragmentary vertical section thereof taken in the direction of arrows 6—6 of FIG. 5 illustrating the assembly of the suspension power connector to the house number sign housing.

A modification of the construction of the house number sign housing adapted for use in conjunction with the present suspension and power connector is shown in FIG. 5 and 6 and is generally designated at 73.

The mount plate 75 for the suspension power connector 73 is triangular in shape as is the underlying anchor plate 27.

The house number sign housing 77 is triangular in cross-section having an open top with the respective side walls arranged at approximately 60 degrees with respect to each other for illustration.

Housing 77 includes a pair of converging forwardly extending side walls 79 of clear plastic material and a corresponding opaque rear wall 81. Said rear wall has formed therein a series of vent apertures 51. Bottom wall 83 is triangular in shape and is constructed of a clear plastic material to permit the transmission of light downwardly of said housing.

Since the converging side walls 79 extend forwardly there is provision upon said sign housing for a pair of house numbers to be read from opposite directions. For this purpose, there are provided upon the bottom wall 83 and adjacent the respective converging side walls 79 the corresponding elongated channels 63 arranged inwardly of the walls 79. Additionally, there are provided as in FIG. 6, a corresponding pair of depending and opposed channels 65 which respectively are in alignment with the underlying channel 63 and are adapted to receive the corresponding translucent plates 67 in the manner above-described with respect to FIG. 4.

In the embodiment shown in FIGS. 5 and 6 there are provided a pair of translucent plates 67 outwardly of the bulb 39. And sandwiched between translucent plates 67 and the corresponding transparent side plates 79 there is provided in each case an elongated opaque strip 69 of the same shape nested within the corresponding channels 63, 65 and held in an upright position. In the strips 69 there are provided the cut-outs 71, FIG. 5, for the house numbers to be illuminated, particularly at night.

The modified sign housing 77, FIGS. 5 and 6, is triangular in shape. Its upper open end is positioned so as to project over the corresponding depending brackets 41 and secured in position by the pair of fasteners 55. These extend through the corresponding transparent plates 79, through the brackets, and into corresponding stationary nuts or other fastener 56 upon the interior of the respective bracket. Thus, the fasteners 55 provide the sole anchorage for the housing 77 for supporting it closely adjacent the anchor plate 27 for enclosing the light source 39 and to provide easy access to the interior of the housing for replacement of the bulb. In the embodiments shown in FIG. 1 and 5, the corresponding suspension and power connectors 23 include the threaded male connector 43. Upon manual rotation of the housing said connectors are threaded into the stationary depending sockets 13 enclosed within a portion of the ceiling 15 of a porch or building overhang of a building, for illustration. A photoelectric eye 84, FIG. 6, or other solid-state circuit is connected into body 23 for turning the light "on" at dusk and "off" at dawn.

Thus, the sole support for the light housings and illuminated signs is the threaded assembly of the power connector body and its male connector 43 into the electrified socket 13.

MODIFICATION

Figure 8:
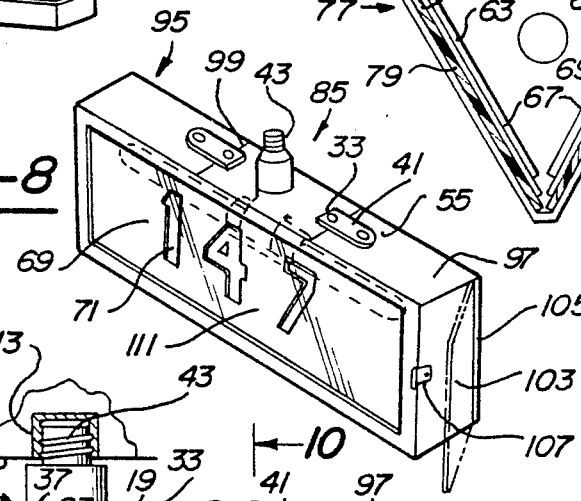
FIG. 8 is a front perspective view of a modified house number sign.

A modified suspension and power connector for an illuminated house number sign is designated at 85, FIG. 8.

Figure 7:
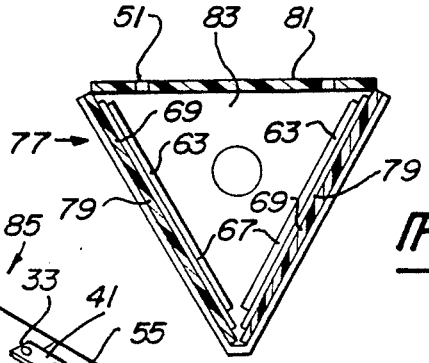
FIG. 7 is a section taken in the direction of arrows 7—7 of FIG. 6.

The electrified socket 87 which corresponds to socket 31 of FIG. 1 adapted to receive the incandescent bulb 39, receives instead a light support 89 having a threaded shank 91 which threads into the socket 87 and includes a pair of opposed outwardly opening sockets 93 adapted to receive and support the opposed aligned bulbs 39, FIG. 7.

Housing 95 differs from the housings of FIGS. 1 and 5 and is laterally positioned including a top wall 97 which has a central aperture or recess 99 to cooperatively receive mount plate 19 which forms a part of the present suspension and power connector 23. In this embodiment, the mount brackets 41 are flat and are secured to the mount plate 19 and anchor plate 27 by the fasteners 33 as an assembly. Brackets 41 laterally outward so as to overlie and supportably engage portions of top wall 97, FIG. 7.

In the illustrative embodiment, the modified suspension power connector is secured with respect to the housing 95 by a pair of second fasteners 55 which extend through the brackets 41 and down through the top wall 97.

The respective fasteners 55 provide the sole mounting and support for the sign housing 95. The suspension and power connector 23 is mounted and suspended from the ceiling 15 within the electrified socket 13 by the male connector 43. In the construction of the power connector 23 and its body, the connector 43 is electrically connected to the socket 87 and to the light sockets 93 to energize the bulbs 39.

In the assembly of the present suspension and power connector 85 into the housing 95 outermost bulb 39 is first removed and the other bulb 39 is first assembled through the aperture 99 in the top wall followed by the support 89 and the power connector 23 until the anchor plate 19 is in registry within the aperture 99 in the top wall 97 with the brackets 41 supportably engaging said top wall. The assembly is completed by the fasteners 55 which extend through the respective brackets and through the corresponding top plate 97 of the housing.

In the illustrative embodiment, one of the outer end walls 103, FIG. 8 is hinged at 105 to the housing 95 and retained closed by a corresponding latch 107. By opening the end wall 103, there is provided access to the adjacent bulb 39 for its replacement or removal in order to disassemble the remainder of the suspension and power connector from the illuminated housing. As in the above number sign housings described there is further provided upon the bottom wall 109 an elongated upstanding channel 63 closely adjacent and rearwardly of the front transparent wall 111.

A pair of longitudinally aligned down-turned channels 65 are secured to and depend from the top wall 97 and are in alignment with channel 63. Positioned within the respective channels 63 and 65 is an elongated rectangular translucent plate 67 supported in an upright position forwardly of the bulbs 39 and closely adjacent the transparent front wall 111.

Further, an elongated opaque card 69 having a series of numerical indicia cut-outs 71 therein, such as house numbers, is snugly interposed between the clear front wall 111 and the translucent plate 67. In the illustrative embodiment, the indicia card is slidably positioned and supported peripherally within the opposed channels 63 and 65.

Figure 9:
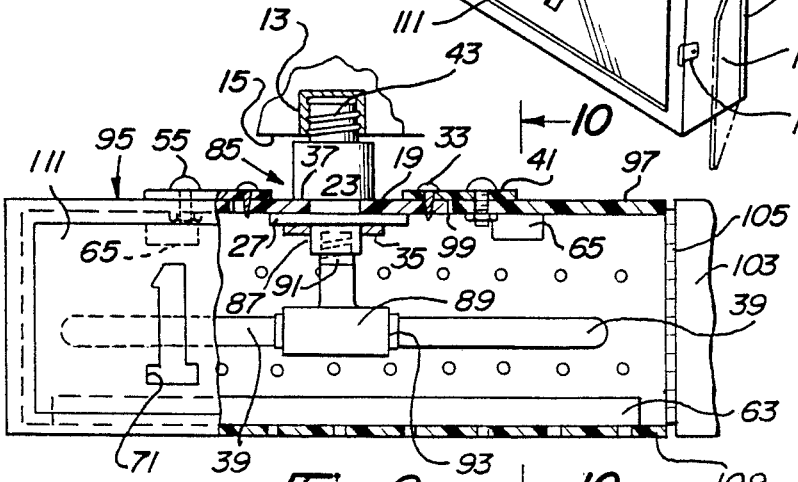
FIG. 9 is a partly sectioned front elevational view thereof, on an increased scale.
Figure 10:
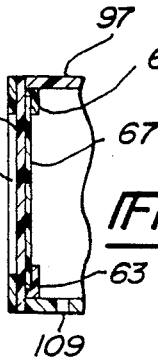
FIG. 10 is a fragmentary section taken in the direction of arrows 10—10 of FIG. 9.

In the embodiment shown in FIG. 9, apertured sealing gasket 35 receives the socket 87 upon the body 23 and bears against the undersurface of anchor plate 27 and is adhered thereto by a suitable adhesive 37.

Having described my invention, reference should now be had to the following claims:

I claim:

1. A suspension and power connector for an illuminated house number sign comprising:
   - a horizontally disposed mount plate having a central aperture;
   - an upright power connector having a body with a longitudinal axis projected through and supportably engaging said mount plate;
   - an anchor plate having a central aperture receiving said body and bearing against said mount plate;
   - a pair of opposed apertured suspension brackets overlying said anchor plate and extending from its opposite ends;
   - first fastener means securing said brackets and said anchor plate to said mount plate;
   - a threaded electrical connector at one end of said body upon said axis, adapted for supported threaded projection into a depending electric socket upon a porch ceiling; and
   - a depending socket upon the other end of said body electrically connected to said electrical connector adapted to receive an incandescent bulb.

2. In the suspension and power connector of claim 1, further comprising the support engagement of said body to said mount plate including a shoulder upon said body.

3. In the suspension and power connector of claim 1, further comprising an apertured sealing gasket mounted over and around said body socket and sealed against said anchor plate.

4. In the suspension and power connector of claim 1, further comprising an elongated hollow housing open at its top having side walls, at least one side wall being opaque, and at least one transparent front wall and a bottom wall;

said housing having a cross-sectional shape corresponding to said anchor plate;

said housing being projected over said bulb into snug engagement with said anchor plate closing off the interior of said housing, said anchor plate functioning as a top cover plate for said housing; and second fasteners interconnecting said brackets with said housing walls.

5. In the suspension and power connector of claim 4, further comprising an upright first channel upon said bottom wall extending along a transparent front wall;

a pair of opposed upright side channels upon opposite sides of said housing aligned with said first channel;

a translucent plate parallel to and adjacent said transparent front wall and held in an upright position within said channels forwardly of said bulb; and an opaque elongated card with numerical indicia cut-outs therein defining a house number, snugly interposed between said translucent plate and said front wall and peripherally retained by said channels.

6. In the suspension and power connector of claim 4, further comprising a plurality of vent apertures formed through a side wall of said housing.

7. In the suspension and power connector of claim 4, further comprising said brackets being angular and depending downwardly, said second fastener means including a pair of stationary nuts secured upon the interior of said brackets in registry with corresponding transverse apertures in said walls; and bolts projected through said apertures and into snug engagement with said nuts.

8. In the suspension and power connector of claim 4, further comprising there being a pair of opposed opaque side walls and a back wall, said second fasteners being the sole anchorage of said housing to said suspension and power connector, said housing and power connector and suspension being rotatable upon said axis for removal of the complete assembly from said ceiling and for access to said bulb.

9. In the suspension and power connector of claim 4, further comprising said bottom wall having a transparent window thereon for passage of light.

10. In the suspension and power connector of claim 4, further comprising said mount plate and anchor plate being triangular;

said housing being triangular in cross-section and having a pair of forwardly converging transparent front walls and a back wall, the top edges of said walls being in an engaging registry with said anchor plate; and said brackets being down turned and bearing against said converging walls and secured thereto.

11. In the suspension and power connector of claim 10, further comprising first channels upon said bottom wall extending along said transparent converging walls;

pairs of opposed upright second channels upon opposite sides of said housing aligned with said first channels respectively;

a translucent plate parallel to and adjacent each of said transparent converging walls and held in an upright position within said channels respectively; and an elongated opaque card with corresponding numerical indicia cut therein defining a house number, snugly interposed between the respective converging front plates and adjacent translucent plates and peripherally suspended within the respective channels.

12. In the suspension and power connector of claim 1, further comprising said socket upon said power connector body including a pair of opposed outwardly opening threaded receptacles;

each receptacle adapted to supportably receive a light bulb.

13. In the suspension and power connector of claim 1, further comprising a laterally elongated housing having opaque top, bottom, back and end walls and a transparent front wall;

said top wall having a central opening cooperatively receiving said mount plate;

said brackets overlying and extending over adjacent portions of said top wall and supporting said mount plate in planar alignment with said top wall; and second fasteners interconnecting said brackets and top wall.

14. In the suspension and power connector of claim 13, further comprising said power connector body and socket and light bulbs being protectively enclosed within said housing.

15. In the suspension and power connector of claim 13, further comprising an upright first channel upon said bottom wall extending along said front wall;

a pair of spaced aligned second channels depending from said top wall and aligned with said first channel;

an elongated translucent plate parallel to and adjacent said front wall held in an upright position within said channels; and an elongated opaque card with numerical indicia cut-outs therein defining a house number snugly interposed between said translucent plate and front wall and peripherally retained by said channels.

16. In the suspension and power connector of claim 13, further comprising said socket upon said power connector body including a pair of opposed outwardly opening threaded receptacles;

each receptacle adapted to supportively receive a light bulb;

one of said end walls being hinged to the back wall and openable for access to a bulb within said housing.

17. In the suspension and power connector of claim 16, further comprising a latch upon said hinged end wall retaining it closed relative to said housing.

18. In the suspension and power connector of claim 1, further comprising said socket upon said power connector body including a pair of opposed outwardly opening threaded receptacles;

each receptacle adapted to supportably receive a light bulb;

a laterally elongated housing having opaque top, bottom, back and end walls and a transparent front wall;

said top wall having a central opening cooperatively receiving said mount plate;

said brackets overlying and extending over adjacent portions of said top wall and supporting said mount plate in planar alignment with said top wall; and second fasteners interconnecting said brackets and top wall.

* * * * *